US006089566A

United States Patent [19]

Xu et al.

[11] Patent Number: 6,089,566

[45] Date of Patent: Jul. 18, 2000

[54] SHEET SUPPLY AND TRANSFER DEVICE FOR PRINTERS PRESUMABLE OF SHEET SIZE FOR PINCH ROLLERS

[75] Inventors: Weihua Xu; Yoshikazu Hara; Hisashi Sanagi, all of Ibaraki-ken, Japan

[73] Assignee: Riso Kagaku Corporation, Tokyo, Japan

[21] Appl. No.: 09/090,988

[22] Filed: Jun. 5, 1998

[30] Foreign Application Priority Data

Jun. 13, 1997 [JP] Japan ..... 9-173172

[51] Int. Cl.[7] ..... B65H 7/02

[52] U.S. Cl. ..... 271/265.01; 271/171; 271/272; 271/265.03

[58] Field of Search ..... 271/171, 227, 271/272, 265.01–265.03

[56] References Cited

U.S. PATENT DOCUMENTS 5,826,156 10/1998 Natsume et al. ..... 271/171

FOREIGN PATENT DOCUMENTS 0 639 466 2/1995 European Pat. Off. .
0 670 217 9/1995 European Pat. Off. .
1-117137 5/1989 Japan .
6-144640 5/1994 Japan .
6-183575 7/1994 Japan .
6-227678 8/1994 Japan .
7-52517 2/1995 Japan .
7-137420 5/1995 Japan .

*Primary Examiner*—Christopher P. Ellis
*Assistant Examiner*—Mark A Deuble
*Attorney, Agent, or Firm*—Oliff & Berridge, PLC

[57] ABSTRACT

In the device for automatically controlling the position of a pair of pinch rollers for pressing opposite side edge portions of a sheet delivered from a printing portion of a printer at a surface thereof bearing a print image according to a detection of the spacing between a pair of side fences for aligning opposite sides edges of a stack of sheets charged on a sheet supply tray, a detection error of the sheet width due to a disturbance of stack condition of the sheets or an incorrect contact of the side fence to the side edge of the stack of sheets is automatically corrected by the spacing between the pair of side fences being compared with the width of sheets of regular sizes, while the pinch rollers being positioned by assuming that the sheets are of one of the regular sizes when the difference of the comparison is within a predetermined numerical range.

5 Claims, 7 Drawing Sheets

SHEET SUPPLY AND TRANSFER DEVICE FOR PRINTERS PRESUMABLE OF SHEET SIZE FOR PINCH ROLLERS

BACKGROUND OF THE INVENTION

1. Field of the Invention

The present invention relates to the art of printers, and more particularly, to a sheet supply and transfer device for printers for transferring sheets of a rectangular contour as transferred from a stack thereof one by one through a printing portion of the printer.

2. Description of the Prior Art

FIG. 1 is a side view showing somewhat diagrammatically an example of a rotary type stencil printing apparatus conventionally known and actually used. In this figure, a generally cylindrical printing drum 10 has perforated construction in its principal portion of its cylindrical circumference, except its annular edge portions at its axially opposite ends and a transverse bar portion 12 bridged therebetween, as well known in the art. A perforated stencil sheet is mounted at its leading edge to a clamp means (not shown) provided on the transverse bar portion 12 and is wrapped around the cylindrical circumference of the printing drum toward its trailing edge. The printing drum is driven by a driving means not shown in the figure to rotate around a central axis thereof in the counter-clockwise direction in the figure, with ink being supplied from its inside by an ink supply means not shown but well known in this art. A paper drum 14 is of the same diameter as the printing drum 10, formed with transverse groove 16 at a portion thereof for avoiding interference with the transverse bar portion 12 of the printing drum 10. The paper drum 14 is driven to rotate around its central axis in the clockwise direction in the figure in synchronization with the counter-clockwise rotation of the printing drum 10 via a linkage mechanism not shown in the figure. A printing portion is established by the printing drum 10 and the paper drum 14, to which, in synchronization with the rotation of the printing drum 10 and the paper drum 14, an uppermost sheet of a stack 20 of regular sheets supported on a sheet supply tray 18 is fed one by one by a sheet feed out roller 22, so that each sheet is transferred through a nip portion between the printing drum 10 and the paper drum 14, so as to be applied with an image of ink on its upper surface according to the perforations of the stencil sheet wrapped around the printing drum 10 under a back pressing by the paper drum 14, the sheet being further guided through a nip portion of a first pair of pinch rollers 24 and the paper drum 14 rightward in the figure, and further being transferred through a nip portion between a second pair of pinch rollers 26 and a discharge roller 28 toward a sheet discharge tray 30. The first and second pairs of pinch rollers 24 and 26 are adapted to be driven by an output shaft 32 of a pinch roller drive motor (not shown) via an endless belt 34.

The pinch rollers 24 and 26 contact the upper surface of the sheet applied with the image of ink, i.e. a print. Therefore, these pinch rollers should contact the sheet only in a pair of narrowly limited regions extending along the opposite side edges of the sheet. Therefore, the pair of pinch rollers adapted to contact the sheet along those narrowly limited side edge portions thereof need to be adjusted of their positions so as to meet with the width of the paper sheets for printing which changes according to a kind of the paper sheets such as, for example, sizes A4, B4, etc.

On the other hand, the sheet supply tray 18 is provided with a pair of side fences 36 for properly aligning the opposite side edges of the stack of sheets 20 charged thereon. Therefore, in some printers of this type advanced in automation are so constructed that the spacing between the pair of side fences 36 adjustable of the positions thereof according to the width of printing sheets is detected by an appropriate sensor, and the pair of pinch rollers are automatically positioned based upon the detected magnitude of the spacing.

Such a construction that the spacing between the side fences of the sheet supply tray is detected by a sensor and the positions of a pair of pinch rollers are automatically set up operates effectively when sheets are correctly stacked on the tray and the side fences are properly set up against the stack of sheets. However, when such a premise is deformed, the deformation directly affects the positioning of the pinch rollers, rendering the positioning of the pinch rollers relative to the width of the actual sheets not to be proper.

In automatically setting up the pair of pinch rollers by detecting a position of the side fences, it is generally conventional to link the movement of the pair of side fences with one another by a linking mechanism such as a rack-and-pinion, so that the pair of side fences move symmetrically relative to one another with respect to its middle point in their approaching or departing movement for decreasing or increasing the spacing therebetween, while the pair of pinch rollers are also moved symmetrically to one another relative to the center line in accordance with corresponding movement of the side fences. According to such a conventional system, there can occur such conditions as shown in FIGS. 2A, 2B and 2C. In more detail, in the case of FIG. 2A, although the stack 20 of sheets is properly formed, one or both of the pair of side fences (both in the shown example) are not properly contacted to the stack of sheets, as being apart therefrom. In such a condition, when the pair of pinch rollers 26 are set up according to the distance between the side fences, a condition such as shown in FIG. 2*a* occurs, wherein the opposite side edges of the sheet are not sufficiently pressed by the pinch rollers or not pressed at all as in the shown example.

In an example shown in FIG. 2B, each sheets forming the stack 20 are randomly displaced relative to one another in their width. Such a condition can often occur in the second and subsequent printing of a multi-color printing. In this case, although the pair of side fences are sufficiently contacted to the opposite side edges of the stack of printing sheets as a whole, each sheet is not properly aligned as shifted on one side or the other, so that on either side the pinch roller can not properly press the sheet as shown in FIG. 2*b*.

FIG. 2C shows a case that a small number of sheets are stacked to form a relatively thin stack of sheets which is readily bendable when the pair of side fences are set up too close to one another. In this case, as shown in FIG. 2*c*, the pair of pinch rollers are biased to the inside of the sheets from proper positions which might cause the pinch roller to roll on a printed image.

SUMMARY OF THE INVENTION

In view of the above-mentioned problems in the sheet supply and transfer device of a printer, it is a primary object of the present invention to provide an improved sheet supply and transfer device of a printer in which the pinch rollers are more appropriately positioned in response to the width of sheets.

In order to accomplish the above-mentioned primary object, the present invention proposes a sheet supply and transfer device for printers, comprising a sheet supply tray adapted to support a stack of sheets, the tray having a pair of side fences for aligning opposite sides of the stack of sheets therebetween, means for transferring the sheets one by one from the sheet supply tray toward a printing portion of the printer, and a pair of pinch rollers for guiding the sheet formed with a printed image at the printing portion in a direction of transfer thereof, by pressing the printed sheet at opposite edges thereof on a surface where the printed image is, characterized by means for detecting a distance between the pair of side fences and generating a signal indicating the distance, and means for setting the pair of pinch rollers to a respective position corresponding to one of regular sheet sizes when the distance between the side fences indicated by the signal is within a first numerical value predetermined for the regular sheet size.

A sheet supply and transfer device for printers of the above-mentioned construction may further comprise means for setting the pair of pinch rollers to a respective position corresponding to the distance indicated by the signal when the spacing expressed by the signal is out of said first numerical value.

A sheet supply and transfer device for printers of the above-mentioned construction may further comprise means for generating an error signal for warning that the sheets are not properly mounted onto the tray when the spacing expressed by said signal is out of said first numerical value but is within a second numerical value slightly broader than said first numerical value.

A sheet supply and transfer device for printers of the above-mentioned construction may further comprise means for setting the pair of pinch rollers to a respective position corresponding to the distance indicated by the signal when the spacing expressed by the signal is out of said second numerical value.

A sheet supply and transfer device for printers of the above-mentioned construction may further comprise means for controlling each positions of the pair of side fences so as to be symmetric to one another with respect to a center line of a route of transfer of the sheets, the pinch roller positioning means including means for moving the pair of pinch rollers symmetrically to one another with respect to said center line.

By the pinch rollers being positioned for a certain regular size of sheets when the width of the sheets expressed by the result of the detection of the position of the side fences is within the first numerical value predetermined for the certain regular size of sheets even when the detected width of the sheets does not coincide with the width of the certain regular size of sheets, assuming that the sheets are of the certain regular size, instead of positioning the pinch rollers faithfully to the detected width of the sheets, while deeming the difference in the width to be disturbance in the stacking condition of the stack of sheets or an error in the contact of the side fences with the stack of sheets, the pinch rollers are properly positioned, by automatically correcting such a disturbance and/or error.

When the width of the sheets detected from the position of the side fences is out of the first predetermined numerical value, the pinch rollers may be positioned to correspond to the spacing between the side fences.

Further, by the second numerical range slightly broader than the first numerical range for presuming the sheets to be of a regular size from the width of the sheets detected from the position of the side fences being so determined that, when the width of the sheets detected from the position of the side fences is out of the first numerical range but is within the second numerical range, although it is guessed that the sheets are of the regular size, it is anticipated that the stacking condition of the sheets is so much disturbed that when the pinch rollers are positioned for the regular size of the sheets, the pinch rollers would be biased too much improperly relative to the sheets, resulting in a too poor pressing condition of the sheets by the pinch rollers, a failure in the printing due to an improper stacking of the sheets on the sheet supply tray is avoided beforehand, with indication of an error signal.

Further, when the second numerical range is set up as described above, it can be judged that the sheets are of a non-regular size only when the width of the sheets detected from the position of the side fences is out of the second numerical range, so that the pinch rollers are positioned to correspond to the width of the sheets detected from the position of the side fences, whereby it can be avoided that the printing carried out at a very high probability by using sheets of the regular sizes is carried out in a condition that the sheets are charged on the sheet supply tray in an unduly disturbed condition, while ensuring an availability of automatic positioning of the pinch rollers even for the sheets of a non-regular size.

In carrying out the present invention described above, the side fences may be constructed as a pair adapted to move symmetrically to one another with respect to a center line of a transfer route of the sheets, and the pair of pinch rollers may also be constructed to move symmetrically to one another with respect to said center line. In this case, when the maximum value of the numerical range for deeming the sheets to be of a regular size is made to be greater than the width of the corresponding regular size sheet by two times of a difference between a maximum allowable biasing of the pinch roller from the side edge toward the center of the sheets and a standard biasing thereof, it is avoided that the pinch roller is biased from the side edge of the sheet toward the center thereof beyond the maximum allowable biasing, by the pinch rollers being positioned based upon the assumption that the sheets are of a certain regular size, in spite of a discrepancy between the width of the sheets detected from the position of the side fences and a corresponding width value of the regular size.

Now, referring to FIGS. 3A and 3B, it is assumed that, when a stack 20 of sheets in a properly stacked condition is properly positioned with opposite side edges thereof in a proper contact with a pair of side fences 36, a pair of pinch rollers 26 press the sheet S transferred along the route of transfer of the sheets fed out from the stack of sheets, as much as 5 mm toward inside from the opposite edges thereof.

Then, it is assumed that, in such a device, the stack of sheets stacked in a proper condition is distance from the pair of side fences 36 at opposite side edges thereof as much as 1.5 mm as shown in FIG. 4A. In this case, when the maximum value of the above-mentioned numerical range for deeming a sheet having a certain width detected from the position of the side fences 36 to be a regular size of a corresponding width is larger than the actual width of the regular size by 3 mm or more, the stack of sheets is deemed to be of a regular size, so that the pair of pinch rollers 26 are positioned as shown in FIG. 4B, to be at the same position as in FIG. 3B. In this case, therefore, the sheet S transferred along the route of transfer as fed out from the stack of sheets is pressed by the pair of pinch rollers 26 in the same proper manner as in the case of FIG. 3A where the stack of sheets is properly contacted by the pair of side fences at the opposite side edges thereof, the pinch rollers 26 each pressing the sheet as much as 5 mm toward inside from each side edge. If in this case the pair of pinch rollers 26 are positioned based upon the width of the sheets determined from the position of the side fences 36, they will be positioned as shown in the broken lines in FIG. 4B, pressing each side edge portion of the sheets only as much as 3.5 mm.

As shown in FIG. 5A, when the stack of sheets or some sheets thereof is shifted to one side relative to the center line of the transfer of sheets, with one side edge thereof properly contacting one of the side fences 36, while the other side edge thereof being apart from the other one of the side fences 36 as much as 3 mm, and when the maximum value of the numerical range for deeming the sheets to be of a regular size is 3 mm or larger against the width of the regular size, the stack of sheets of FIG. 5A is also deemed to be of the regular size, so that the pair of pinch rollers 26 are set at the same positions as in FIGS. 3B and 4B. In this case, the sheet S fed out from the stack of sheets along the route of transfer thereof is pressed by the pinch roller 26 as much as 6.5 mm toward inside from one side edge thereof, while along the other side edge thereof the pinch roller 26 presses the sheet as much as 3.5 mm toward inside from the side edge. If, in this case, the pair of pinch rollers 26 are positioned only according to the paper width detected from the position of the side fences 36 as in the conventional art, although one pinch roller 26 presses the pinch sheet as much as 5 mm toward inside from one side edge as shown by broken lines in FIG. 5B, along the other side edge of the sheet the pinch roller 26 can press the sheet only as much as 2 mm toward inside from the other side edge.

As will be understood from the example shown in FIGS. 5A and 5B, assuming that the sheets are of a regular size, and the pair of pinch rollers 26 are regularly positioned relative to the regular size in spite of the sheets shifted to one side, when an appropriate consideration is made with respect to the relationship between the standard pressing width and the maximum allowable pressing width by the pinch rollers along the side edges of the sheet, such as to allow a 6.5 mm pressing width over a standard pressing width 5 mm, while determining the difference between the maximum value of the numerical range for deeming the sheets to be of a regular size and the width of the regular size to be twice as much as the difference between the maximum allowable pressing width and the standard pressing width, a pair of side fences and a pair of pinch rollers may be adjusted symmetrically to one another with respect to the center line of the route of transferring the sheets, without the side edge portions of the sheets being pressed by the pinch rollers over the allowable bank areas extending along the opposite side edges of the sheet, even when the stack of sheets is charged onto the sheet supply tray as shifted on one side thereof as shown in FIGS. 5A and 5B.

BRIEF DESCRIPTION OF THE DRAWINGS

In the accompanying drawings.

DESCRIPTION OF THE PREFERRED EMBODIMENT

Figure 1:
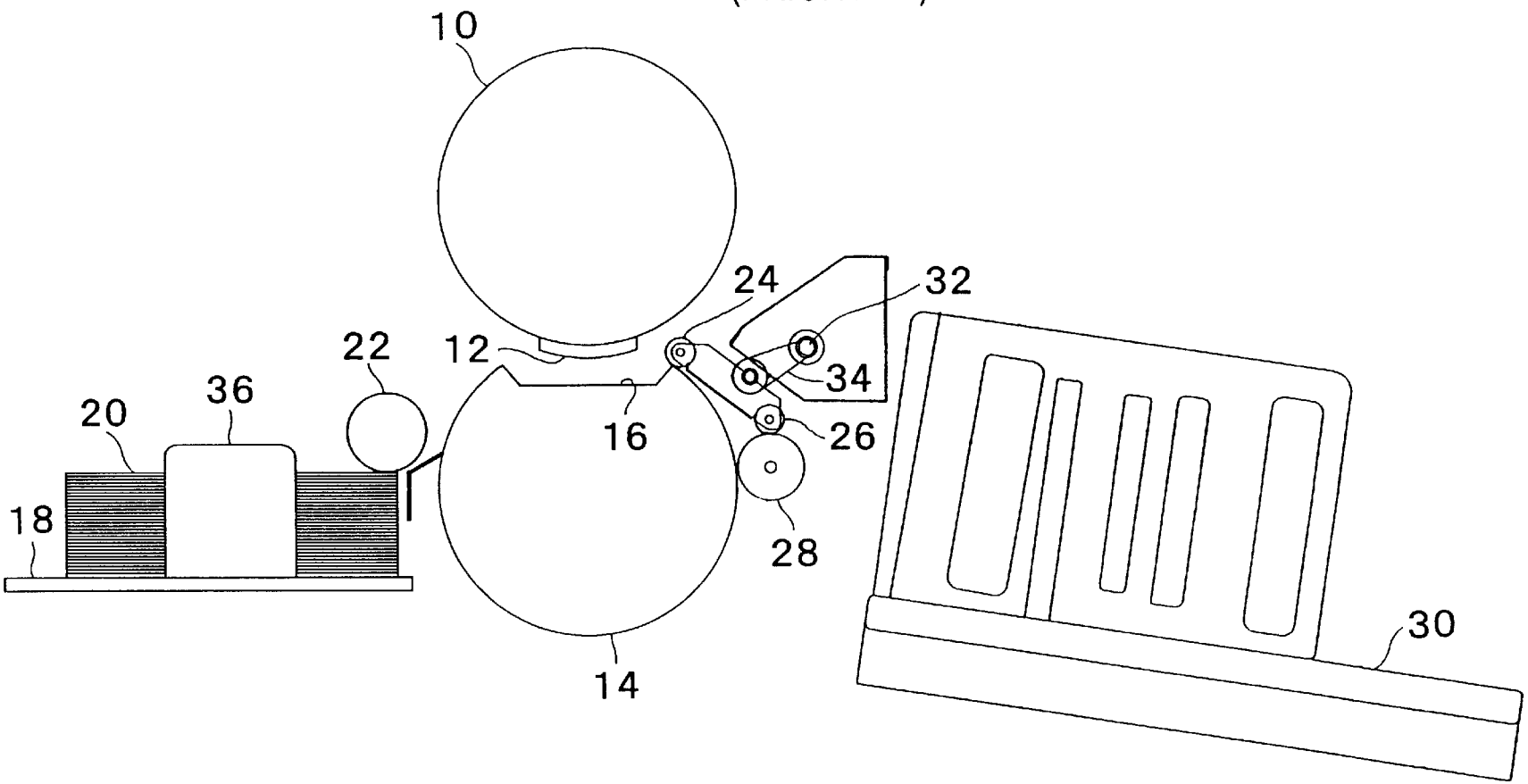
FIG. 1 (PRIOR ART)
FIG. 1 is a side view showing somewhat diagrammatically the construction of a rotary stencil printer suitable for incorporating the sheet supply and transfer device according to the present invention, wherein only those portions of the printer concerned with the present invention are shown.
Figure 2C:
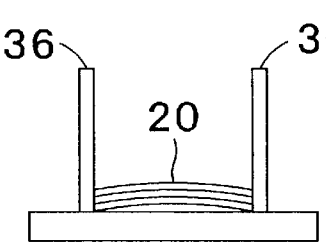
FIG. 2C (PRIOR ART)
FIGS. 2A–2C and FIGS. 2*a*–2*c* are diagrammatical views exemplarily showing troublesome manners of charging the sheets onto the sheet supply tray.
Figure 2B:
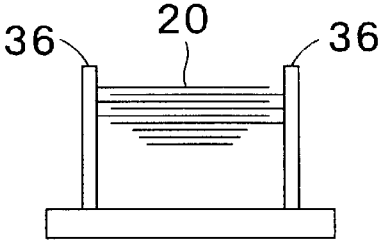
FIG. 2B (PRIOR ART)
Figure 2A:
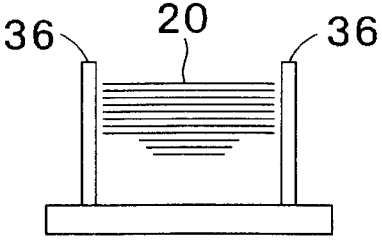
FIG. 2A (PRIOR ART)
Figure 2C:
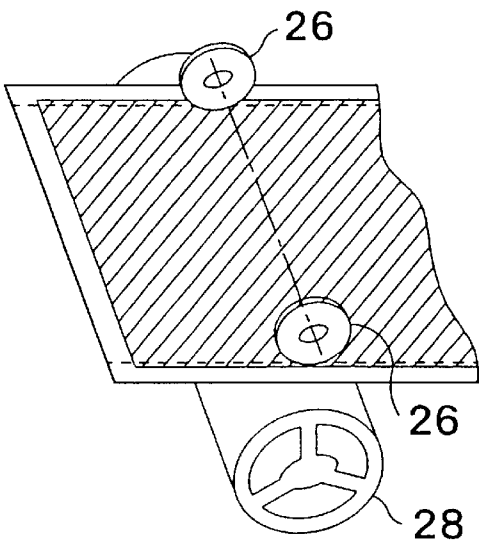
FIG. 2c (PRIOR ART)
Figure 2B:
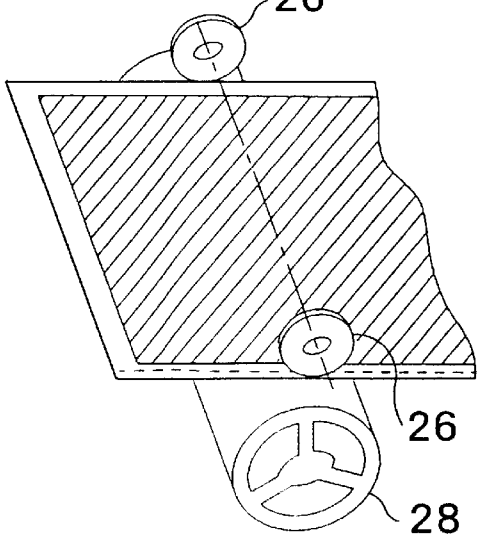
FIG. 2b (PRIOR ART)
Figure 2A:
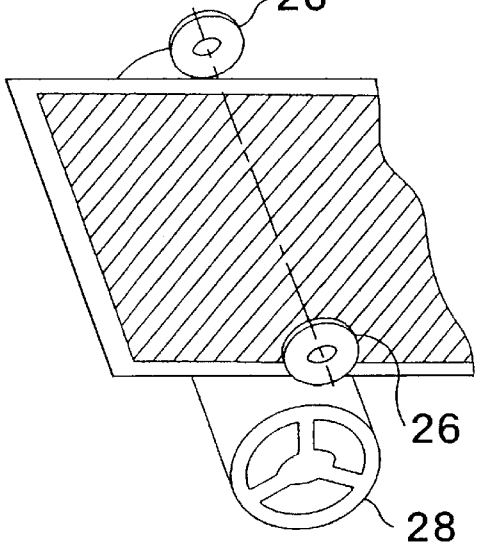
FIG. 2a (PRIOR ART)
Figure 3A:
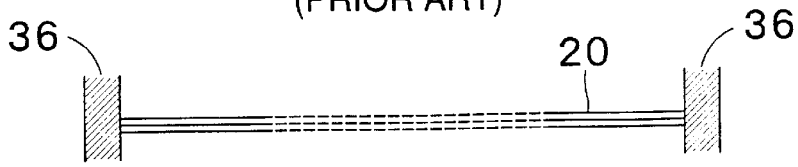
FIG. 3A (PRIOR ART)
FIGS. 3A and 3B are views showing a normal example with regard to the detection of the width of the sheets by the spacing between the side fences and the positioning of the pinch rollers.
Figure 3B:
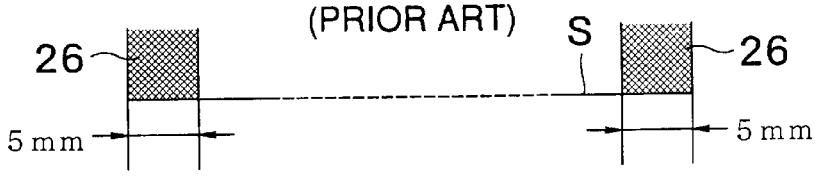
FIG. 3B (PRIOR ART)
Figure 4A:
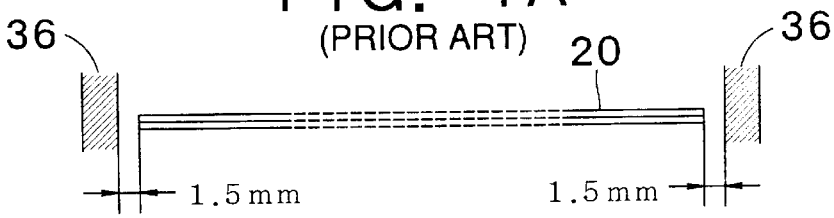
FIG. 4A (PRIOR ART)
FIGS. 4A and 4B are views showing a troublesome example with regard to the detection of the width of the sheets by the spacing between the side fences and the positioning of the pinch rollers.
Figure 4B:
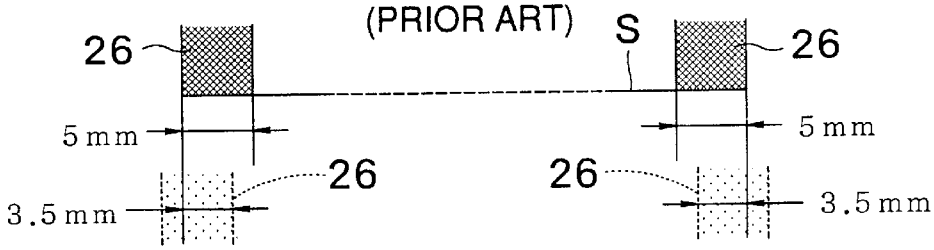
FIG. 4B (PRIOR ART)
Figure 5A:
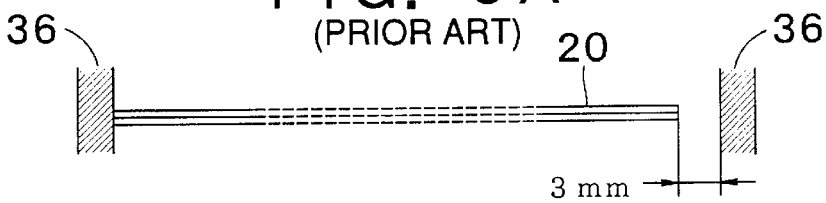
FIG. 5A (PRIOR ART)
FIGS. 5A and 5B are views showing another troublesome example with regard to the detection of the width of the sheets by the spacing between the side fences and the positioning of the pinch rollers.
Figure 5B:
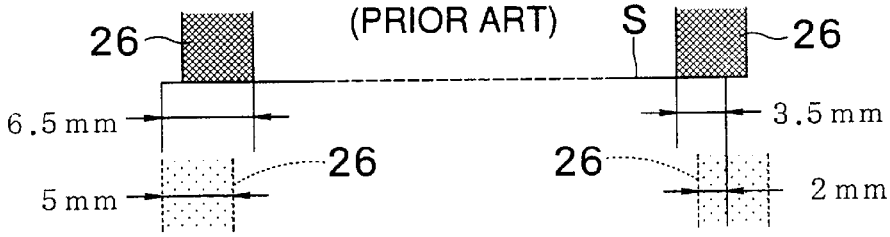
FIG. 5B (PRIOR ART)
Figure 6:
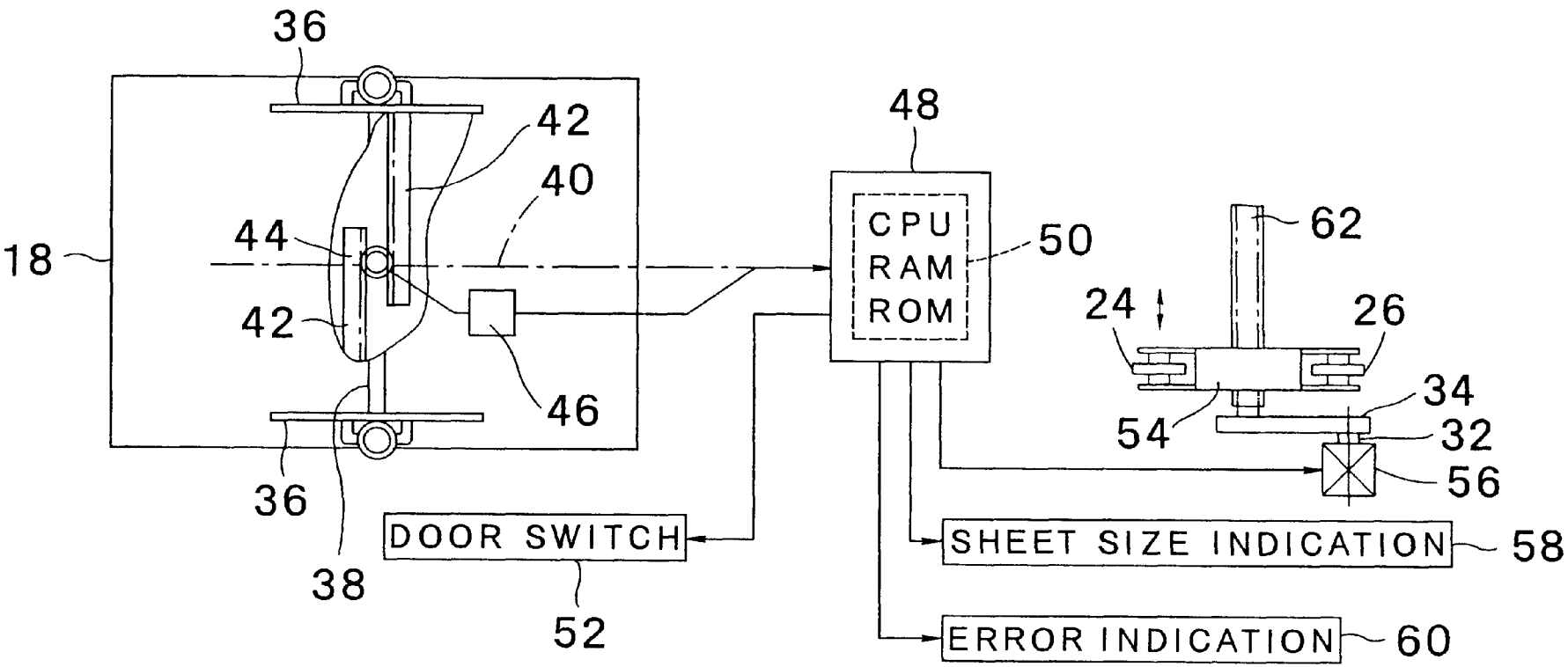
FIG. 6 is a diagrammatical view showing an embodiment of the sheet supply and the transfer device of a printer according to the present invention.

FIG. 6 is a diagrammatical view showing an embodiment of the sheet supply and transfer device of a printer according to the present invention, wherein portions belonging to the conventional art and shown in FIG. 1 are designated by the same reference numerals as in FIG. 1. In more detail, a sheet supply tray 18 is shown in a plan view in FIG. 6. A pair of side fences 36 are adapted to be movable along a rail 38 in a direction perpendicular to a center line 40 of a route of transfer of the printing sheets. The pair of side fences 36 are each provided with a rack 42 each meshing with a pinion 44 rotatably supported by the sheet supply tray 18 to rotate about a point on the center line 40, so that the pair of side fences 36 are linked with one another in their movement along the rail 38, approaching to or departing from one another symmetrically with respect to the center line 40 of the route of transfer of the sheets. The position or the spacing between the pair of side fences 36 is detected by a side fence position sensor 46 connected to the pinion 44.

An electric controller 48 is an essential portion constructed by a microcomputer 50 including CPU, RAM and ROM. The electronic controller 48 is supplied with a signal regarding the position of the side fences from the side fence position sensor 46, and a signal regarding open/close of a door (not shown) adapted to be opened when sheets are charged onto the sheet supply tray 18 from a door switch 52, then conducts a control calculation such as described hereinbelow, and then dispatches based thereupon output signals to a motor 56 for positioning a pinch roller carrier 54 supporting pinch rollers 24 and 26, a sheet size indicator 58 for indicating the sizes of the sheets charged onto the sheet supply tray 18, and an error indicator for warning when the charging of the sheets onto the sheet supply tray 18 or the positioning of the side fences 36 is not properly done. In more detail, the pinch roller carrier 54 is in a screw engagement with a screw rod 62, so that when the screw rod 62 is rotationally driven by the motor 56 through its output shaft 32 and an endless belt 34, the pinch rollers are correspondingly positioned. The pinch rollers 24 and 26 and the pinch roller carrier 54 shown in FIG. 6 are each one of a pair of those elements provided as a pair, with such another pinch roller carrier being engaged with the other end portion of the screw rod 62 (not shown) formed with threads opposite to those form in the shown portion in the direction of the helicoid thereof, so that such a pair of pinch rollers approach to one another when the screw rod 62 is rotated in one direction, while the pinch rollers depart from one another when the screw rod 62 is rotated in the other rotational direction.

Figure 7:
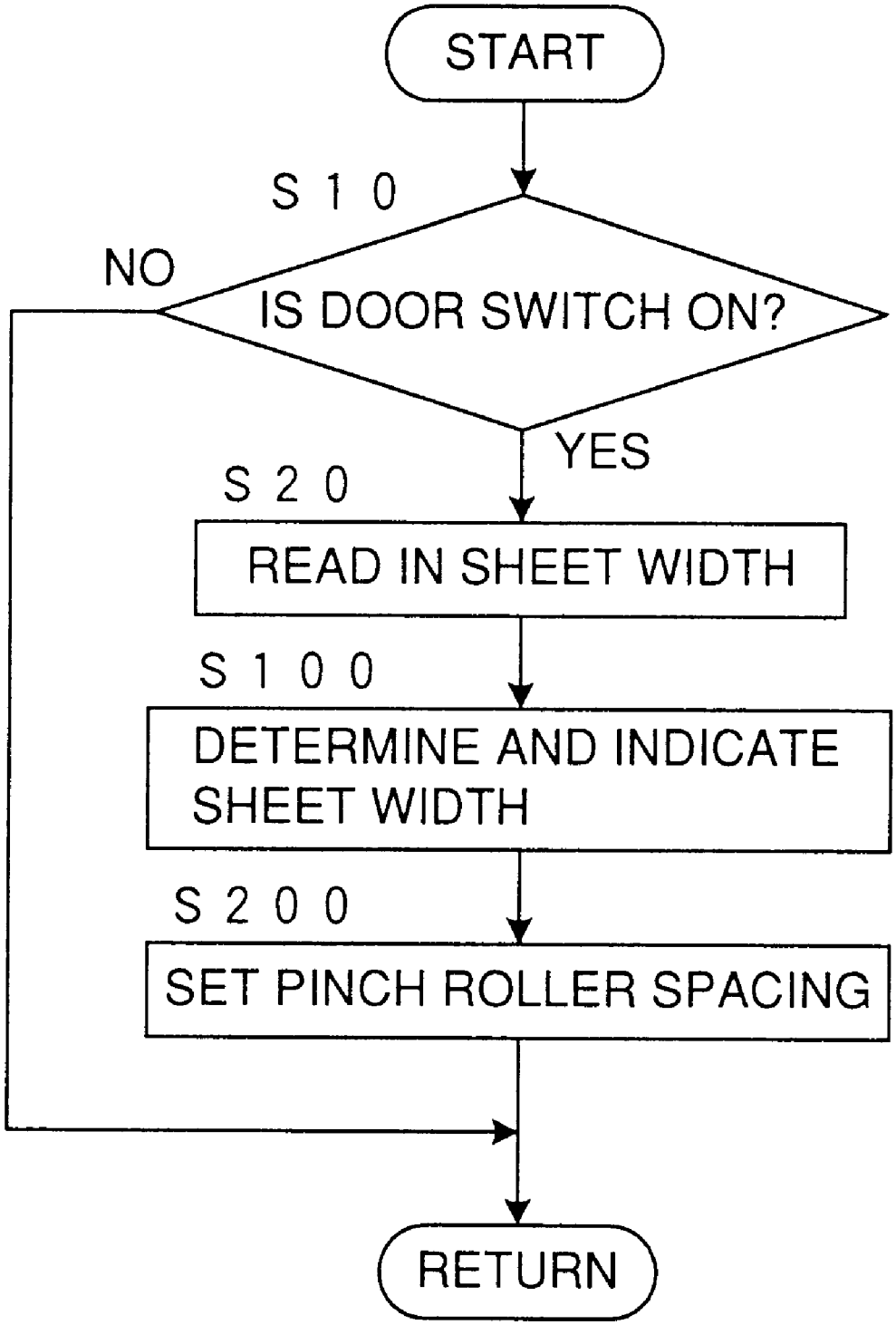
FIG. 7 is a flowchart showing an overall operation of the sheet supply and transfer device of a printer according to the present invention.

FIG. 7 is a flowchart illustrating the operation of the sheet supply and transfer device of a printer according to the present invention shown in FIG. 6. When a power switch of the printer having an overall construction such as shown in FIG. 1 in which the sheet supply and transfer device according to the present invention is incorporated is put on, the sheet supply and transfer device of the present invention starts to operate. Then, in step 10, it is judged if the door switch 52 is on or not. When the printer is not under charging of the sheets or the like with the door being closed, the door switch is in an on condition. In this case, the control proceeds to step 20, and the width of the sheets is read in as a signal from the side fence position sensor 46. Then the control proceeds to step 100, and the width of the sheet is determined and indicated in the manner described hereinbelow with reference to FIG. 8. Then the control proceeds to step 200, and the pinch rollers are positioned according to the manner described hereinbelow with reference to FIG. 9. When it is judged in step 10 that the door switch is not on, the controls of steps 20, 100 and 200 are not executed. The operations according to a main routine shown in FIG. 7 are repeated at a cycle time such as several tens of microseconds throughout the time when the power switch of the printer is closed.

Figure 8:
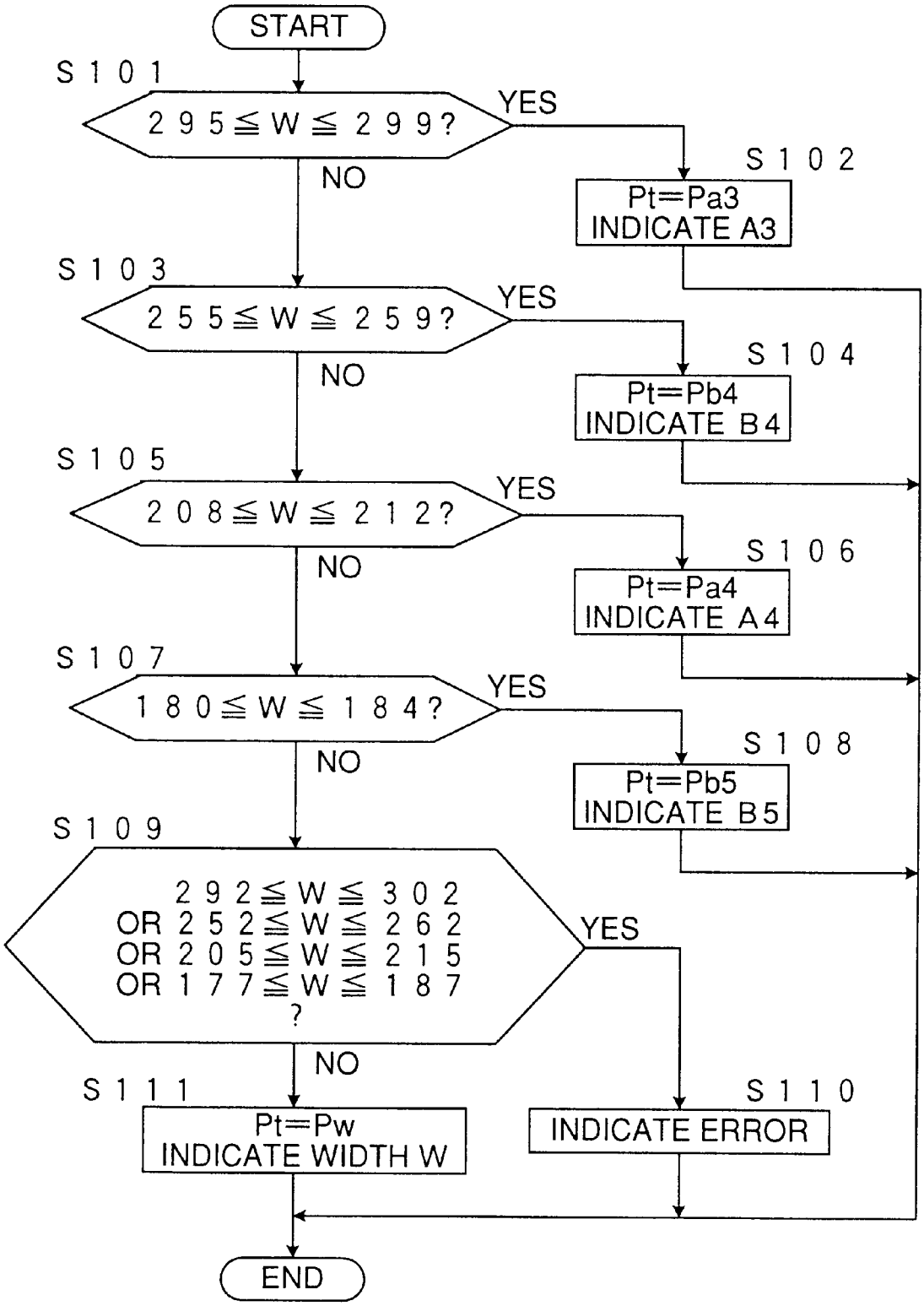
FIG. 8 is a flowchart showing details of the control operation of step 100 in the flowchart of FIG. 7.

FIG. 8 is a flowchart showing the details of a sub-routine executed in step 100 in FIG. 7.

In step 101, it is judged if the width W read in in step 20 of FIG. 7 is between 295 and 299 by the unit of mm (the same hereinbelow). When the answer of the judgement is yes, the control proceeds to step 102, and a target value Pt of the spacing between the pair of pinch rollers is set to a value Pa3 predetermined for the sheets of size A3, with an indication of A3 by the sheet size indicator 58. Then the control operation by this sub-routine is ended.

When the answer of the judgement in step 101 is no, the control proceeds to step 103, and it is judged if the width W is between 255 and 259. When the answer of the judgement is yes, the control proceeds to step 104, and the target value Pt of the spacing of the pinch rollers is set to Pb4 predetermined for the sheets of size B4, with an indication of B4 by the sheet size indicator 58.

When the answer of the judgement in step 103 is no, the control proceeds to step 105, and it is judged if the width W of the sheets is between 208 and 212. If the answer of the judgement is yes, the control proceeds to step 106 and the target value of Pt of the spacing between the pinch roller is set to Pa4 predetermined for the sheets of size A4, with an indication of A4 by the sheet size indicator 58.

When the answer of the judgement in step 105 is no, the control proceeds to step 107, and it is judged if the width W of the sheet is between 180 and 184. When the answer of the judgement is yes, the control proceeds to step 108, and the target value Pt of the spacing between the pinch rollers is set to Pb5 predetermined for the sheets of size B5, with an indication of size B5 by the sheet size indicator 58.

When the answer of the judgement in step 107 is no, the control proceeds to step 109, and it is judged if the width W of the sheets is between 292 and 302, between 252 and 262, between 305 and 315, or between 177 and 187. If the answer of the judgement is yes, the control proceeds to step 100, where no setting of the target value of the spacing between the pinch rollers is done, with an error indication by the sheet size indicator 58.

When the answer of the judgement in step 109 is no, the control proceeds to step 111, and the target value Pt of the spacing between the pinch rollers is set to a value Pw suitable for the sheets having a width W just as detected by the side fence position sensor 46, with an indication of the width W in the unit of mm by the sheet size indicator 58.

In this connection, steps 109 and 110 may be omitted, or a changeover switch may be provided to select between the execution of steps 109 and 110 and the omission of these steps.

Figure 9:
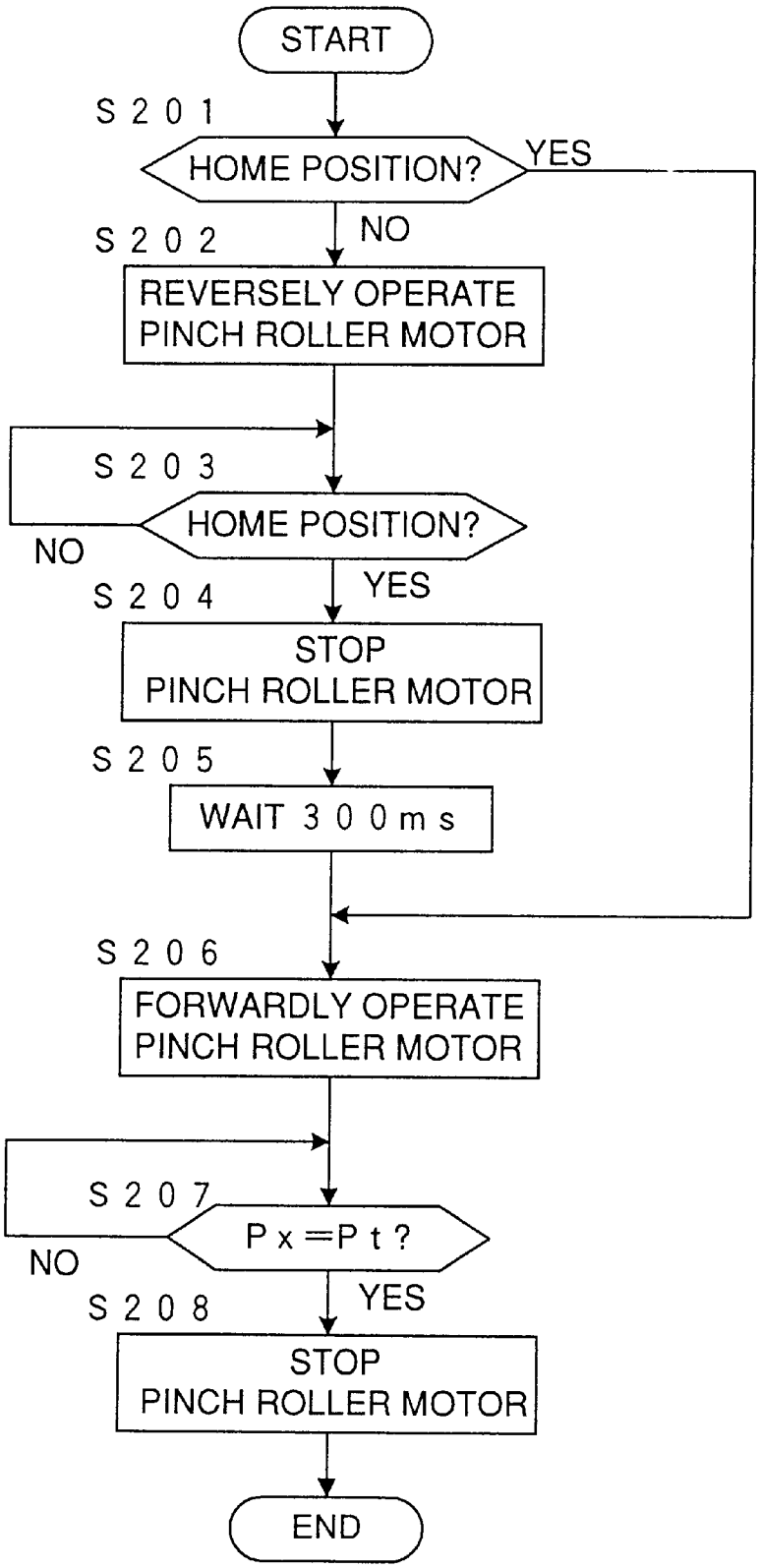
FIG. 9 is a flowchart showing details of the control operation of step 200 in the flowchart of FIG. 7.

In step 200 of FIG. 7, the control processes shown in FIG. 9 are executed.

In step 201, it is judged if the pair of pinch roller carriers 54 are at their predetermined home positions most distant from one another. If the answer of the judgement is no, the control proceeds to step 202, and the motor 56 for driving the pinch rollers is operated in its reversed direction, so that the pair of pinch roller carriers 54 are driven toward the home positions to be most distant from one another. Then step 203, it is judged if the pinch roller carriers have reached the home position. The step 203 is repeated until the answer of its judgement becomes yes, i.e. the pinch roller carriers reach the home positions.

When the answer of the judgement of step 203 becomes yes, the control proceeds to step 204, and the motor 56 for moving the pinch rollers is stopped, and the control proceeds to step 205, wherein a delay time such as 300 ms is spent. After the lapse of the delay time, the control proceeds to step 206, and the motor 56 is operated in the forward direction. When the answer of the judgement in step 201 is yes, i.e., the pinch roller carriers 54 are at the home position from the beginning, the control immediately proceeds to step 206, so that the control operation is started from here. Then the control proceeds to step 207, and it is judged if the spacing Px between the pinch rollers is equal to the target value Pt therefor set in the sub-routine of FIG. 8. When the motor 56 for moving the pinch rollers is constructed by a step motor, so that a stepwise rotation of the step motor in the forward or backward direction is controlled by counting the number of pulses of electric currents by the microcomputer 50 in the electric controller 48, the spacing Px between the pinch rollers may be directly detected by the management of the pulses. The step 207 is repeated until Px coincides with Pt.

When the anser of the judgment of step 207 becomes yes, the control proceeds to step 208, and the motor 56 for moving the pinch roller is stopped. The pinch rollers are now set at the predetermined target position.

Although the present invention has been described with respect to an embodiment thereof, it will be apparent for those skilled in the art various modifications are possible with respect to the shown embodiments within the scope of the present invention.

What is claimed is:

1. A sheet supply and transfer device for printers, comprising a sheet supply tray adapted to support a stack of sheets, the tray having a pair of side fences for aligning opposite sides of the stack of sheets therebetween, means for transferring the sheets one by one from the sheet supply tray toward a printing portion of the printer, and a pair of pinch rollers for guiding the sheet formed with a printed image at the printing portion in a direction of transfer thereof by pressing the printed sheet at opposite edges thereof on a surface where the printed image is formed, the device further comprising:

means for detecting a distance between the pair of side fences and generating a signal indicating the distance, and means for setting the pair of pinch rollers to respective positions corresponding to one of predetermined regular sheet sizes when the distance between the side fences indicated by the signal is within such a first numerical value range predetermined for the one regular sheet size that defines a lower limit and an upper limit thereof predetermined for the one regular sheet size so as to allow the pair of pinch rollers regularly set for the one regular sheet size to guide the printed sheets acceptably in spite of irregularities in stacking of the sheets on the sheet supply tray.

2. A sheet supply and transfer device for printers according to claim 1, further comprising means for setting the pair of pinch rollers to respective positions corresponding to the distance indicated by the signal when the distance indicated by the signal is out of a second numerical value range slightly broader than said first numerical value range.

3. A sheet supply and transfer device for printers according to claim 1, further comprising means for generating an error signal for warning that the sheets are not properly mounted onto the sheet supply try when the distance indicated by said signal is out of said first numerical value range but is within a second numerical value range slightly broader than said first numerical value range.

4. A sheet supply and transfer device for printers according to claim 3, further comprising means for setting the pair of pinch rollers to respective positions corresponding to the distance indicated by the signal when the distance indicated by the signal is out of said second numerical value range.

5. A sheet supply and transfer device for printers according to claim 1, further comprising means for controlling respective positions of the pair of side fences so as to be symmetric to one another with respect to a center line of a route of transfer of the sheets, the pinch roller positioning means including means for moving the pair of pinch rollers symmetrically to one another with respect to said center line, said first numerical value ranging having a width corresponding to a twice of a difference between a largest width for the pinch roller allowed to press the sheet from each side edge thereof toward a center thereof and a standard width for the pressing.

* * * * *